US009951961B2

(12) United States Patent
Grigahcine

(10) Patent No.: US 9,951,961 B2
(45) Date of Patent: Apr. 24, 2018

(54) CONTROL HOUSING FOR A HEATING OR VENTILATION OR AIR-CONDITIONING CONTROL SYSTEM, AND SYSTEM EQUIPPED WITH SAID HOUSING

(71) Applicant: FRACOTECH, Sannois (FR)

(72) Inventor: Hacine Grigahcine, Cormeilles en Parisis (FR)

(73) Assignee: FRACOTECH, Sannois (FR)

( * ) Notice: Subject to any disclaimer, the term of this patent is extended or adjusted under 35 U.S.C. 154(b) by 218 days.

(21) Appl. No.: 14/765,223

(22) PCT Filed: Jan. 31, 2014

(86) PCT No.: PCT/FR2014/050181
§ 371 (c)(1),
(2) Date: Dec. 21, 2015

(87) PCT Pub. No.: WO2014/140438
PCT Pub. Date: Sep. 18, 2014

(65) Prior Publication Data

US 2016/0231005 A1 Aug. 11, 2016

(30) Foreign Application Priority Data

Jan. 31, 2013 (FR) ..... 13 50865

(51) Int. Cl.
*F24D 19/00* (2006.01)
*F24D 3/10* (2006.01)
*F24F 13/20* (2006.01)

(52) U.S. Cl.
CPC ..... *F24D 19/0097* (2013.01); *F24D 3/1066* (2013.01); *F24F 13/20* (2013.01); *F24D 2220/02* (2013.01); *F24F 2013/207* (2013.01)

(58) Field of Classification Search
CPC .. F24D 3/1066; F24D 3/1058; F24D 2220/02; F24D 19/0097; F24D 3/125;
(Continued)

(56) References Cited

FOREIGN PATENT DOCUMENTS

DE 2750026 C2 * 4/1982 ..... F24D 3/1066
DE 102007047667 A1 * 4/2009 ..... F24D 3/1058
(Continued)

OTHER PUBLICATIONS

English translation of the International Search Report and of the Written Opinion, dated Aug. 2008, 2014, from corresponding PCT application.

*Primary Examiner* — Tho V Duong
(74) *Attorney, Agent, or Firm* — Young & Thompson

(57) ABSTRACT

Control housing (1) for a heating or ventilation or air conditioning system, consisting in a housing body (2) closed by a lid assembly and being characterized by the fact that the housing body (2) includes at least one hydraulic control compartment (4) in which a hydraulic equipment-receiving space is formed, the hydraulic control compartment (4) including at least one opening (16, 17) for piping element(s) to pass through, the receiving space further including a unit (27, 28, 36) for maintaining in position at least one piping element. The maintaining unit may include a device (27, 28) for supporting piping element(s) which are formed by at least one pair of bearing surfaces (29) and a unit for locking in position at least one piping element against at least one bearing surface (29).

17 Claims, 7 Drawing Sheets

(58) Field of Classification Search
CPC ..... F24D 19/0209; F24F 13/20; F24F 13/207; F24H 9/02
See application file for complete search history.

(56) References Cited

FOREIGN PATENT DOCUMENTS

| | | | | | |
|---|---|---|---|---|---|
| DE | 202011001922 | U1 * | 11/2011 | ..... | F24D 19/0097 |
| DE | 202005021994 | U1 * | 1/2012 | ..... | E04C 2/521 |
| FR | 2468844 | A1 | 5/1981 | | |
| FR | 2721680 | A1 | 12/1995 | | |
| FR | 3031577 | A1 * | 7/2016 | ..... | F24D 3/1066 |
| WO | 2006/070950 | A1 | 7/2006 | | |

* cited by examiner

CONTROL HOUSING FOR A HEATING OR VENTILATION OR AIR-CONDITIONING CONTROL SYSTEM, AND SYSTEM EQUIPPED WITH SAID HOUSING

BACKGROUND OF THE INVENTION

Field of the Invention

The present invention pertains to the field of heating, ventilation and air conditioning, and in particular relates to a housing for a heating or ventilation or air conditioning system.

Description of the Related Art

Most of the time, housing, installing a heating, ventilation and/or air conditioning apparatus requires to call on several building trades, in particular a person in charge of installing the hydraulic equipment, generally directly secured to the wall, the ceiling or the ground, and connecting it, another person in charge of installing the electronic control, which is generally secured to the heating, ventilation and/or air conditioning emitter, and connecting it to the hydraulic equipment for the controlling of the various valves, and yet another person in charge of adjusting or hydraulically balancing the valves.

The hydraulic equipment, in particular the type of piping elements that are used and the number thereof, the number and positioning of the valves, is defined, inter alia, depending on the number of emitters that have to be supplied, on the manner heat and cold for the or each emitter are obtained, for instance directly at the production or by control of the valves of the hydraulic equipment, etc.

Therefore, the arrangement of the hydraulic equipment is determined in order to comply with the end-use requirements.

Involving several building trades on site has the shortcoming of increasing the costs and time for installing the heating, ventilation and/or air conditioning system.

There is thus a need for a solution which reduces the costs and time for installing a heating, ventilation or air conditioning control system, while keeping, for the above-mentioned reasons, the necessary freedom in the arrangement of the hydraulic equipment.

SUMMARY OF THE INVENTION

The present invention aims to satisfy this need, by providing a control housing in which one can easily secure, before installing the housing on site, a wide choice of piping elements, in particular L-shaped, T-shaped or linear piping connectors or piping elbows, provided with their valve and other fittings, chosen depending on the end-use requirements and adjusted accordingly, wherein said housing can be installed on site by a single person which will take care of hydraulically connecting it.

The present invention thus relates to a control housing for a heating or ventilation or air conditioning system, consisting in a housing body closed by a lid assembly and being characterized by the fact that the housing body comprises at least one hydraulic control compartment in which a hydraulic equipment-receiving space is formed, said hydraulic control compartment comprising at least one opening for piping element(s) to pass through, for entry and exit of one or more piping elements into and out of the control housing, said receiving space further comprising means for maintaining in position at least one piping element.

The hydraulic equipment-receiving space may be defined by a bottom wall and side walls and said position maintaining means may comprise, on one hand, means for supporting piping element(s) which are formed by at least one pair of bearing surfaces integral with the housing body, the two bearing surfaces of the same pair being orthogonally symmetric with respect to a plane orthogonal to a straight line passing by both said bearing surfaces and, on the other hand, means for locking in position at least one piping element against at least one bearing surface.

The two bearing surfaces of the same pair being orthogonally symmetric with respect to said symmetry plane, the latter is equidistant to the two bearing surfaces.

The bearing surfaces and the means for locking may be capable of allowing a locking by clamping, in particular of a three-point clamping type, against at least one bearing surface.

The bearing surfaces may each follow an arc of cylinder, and are in particular semi-cylindrical, and the cylinders an arc of which is followed by the two bearing surfaces of the same pair are of the same radius and coaxial, and in particular have an axis parallel to the bottom wall.

Each bearing surfaces may be formed on the free end face of a pillar which, at the other end thereof, is integral with the housing body, in particular with the bottom wall of the hydraulic control compartment.

The housing may comprise at least two pairs of bearing surfaces integral with the same wall of the hydraulic control compartment.

The distance between two bearing surfaces of the same pair may be equal to the distance between the two bearing surfaces of the other pair, the distances being taken in a direction that is parallel to the wall of the hydraulic control compartment with which they are integral, the bearing surfaces being preferably arranged at the four corners of a rectangle, and in particular of a square.

Each pair of bearing surfaces may be offset with respect to the other pair(s) in the direction that is orthogonal to the wall with which the pillars are integral.

The means for locking in position piping element(s) are formed by a rigid member having, for the or each pair of bearing surfaces, a pair of clamping surfaces symmetrical with respect to a plan that is orthogonal to a straight line passing by both said clamping surfaces, the distance separating the clamping surfaces of the same pair being equal to the distance separating the bearing surfaces of the corresponding pair, such that when at least one piping element is locked in position by the rigid member, each clamping surface of the same pair is facing a respective bearing surface of the corresponding pair, the rigid member being provided with means allowing to clamp the rigid member against the respective bearing surface.

Such a rigid member allows to lock in position one or more piping elements with a reduced number of steps, which further simplifies the preparing of the control housing before installing it.

The means for clamping are, for example, formed by screws, through holes extending through the rigid member and threaded holes located on both sides of the bearing surface, the screws passing through said holes which, in the locking, are aligned.

The clamping surfaces may each follow an arc of cylinder, and are in particular semi-cylindrical, and that the cylinders an arc of which is followed by the two clamping surfaces of the same pair are coaxial and of the same radius.

The rigid member may have a general shape of X, the free end regions of each arm of the X having a clamping surface.

Alternatively, the means for locking in position could be integral with one or more among the bottom wall, the side walls and the lid.

Two notches, each constituting an opening for piping element(s) to pass through, may be made from the free edges of two side walls facing each other, said notches are made, preferably, to the vicinity of the bottom wall in order to facilitate the access to the inside of the regulation control compartment.

At least one opening for piping element(s) to pass through is made in the side wall adjacent to the two side walls in which the notches are made.

The pillars may be integral with the bottom wall of the hydraulic control compartment, and, for each pair of bearing surfaces, an opening for piping element(s) to pass through may be provided in the side wall adjacent to the two side walls in which the notches are made, each opening extending along an axis at a distance of the bottom wall that is equal to the distance between the bearing surfaces of the respective pair and said bottom wall, the distances being taken in the direction that is orthogonal to said bottom wall.

The housing body may also comprise, separated from the hydraulic control compartment in a fluid-tight manner, an electronic control compartment for a heating or ventilation or air conditioning and/or large/light current control system, defined by a bottom wall and side walls and in which are provided means for securing at least one automatic control system for controlling valves of hydraulic equipment, at least one opening for power supply wires and connectors being made in at least one said side wall, and means for allowing the passage of wires between the electronic control compartment and the hydraulic control compartment being provided. The passage of the wires may be done directly from the electronic control compartment to the hydraulic control compartment, or may be done indirectly, in which case said means allows the passage of wires between each control compartment and the outside of the housing body.

With such an electronic control compartment, one can place, before installation on site, the electronics of the heating, ventilation, air conditioning or large/light current control system, as well as their various power supply wires and connectors, such that the person who installs the housing and takes care of hydraulically connecting it can also simply perform the electrical connection to the emitter(s), or to a building management computer, usually with plug-in connectors. Thus, it is no longer necessary to call in several building trades on site, which further reduces the costs and time for installing the control system.

The bottom walls of the electronic and hydraulic control compartments are formed by a single flat plate, two opposite edge regions of which constitute mounting flanges the surfaces of which, on the bottom side of the housing, being offset, in the direction that is perpendicular to said plate, with respect to the outer surface of the central portion of the plate which forms the bottom walls, said means for allowing the passage of wires between the electronic and hydraulic control compartments being constituted by a series of wire passage slots which are made in said plate, first slots opening into the electronic control compartment and second slots opening into the hydraulic control compartment.

The present invention also relates to a heating or ventilation or air conditioning control system, characterized by the fact that it comprises a control housing as defined above, a hydraulic equipment maintained in position by the position maintaining means and, if applicable, at least one electronic automatic control system secured in the electronic control compartment.

BRIEF DESCRIPTION OF THE DRAWING FIGURES

In order to better illustrate the subject-matter of the present invention, a particular embodiment thereof will not be described, for illustrative and non limitative purposes, with reference to the appended drawing.

DETAILED DESCRIPTION OF THE INVENTION

Figure 1:
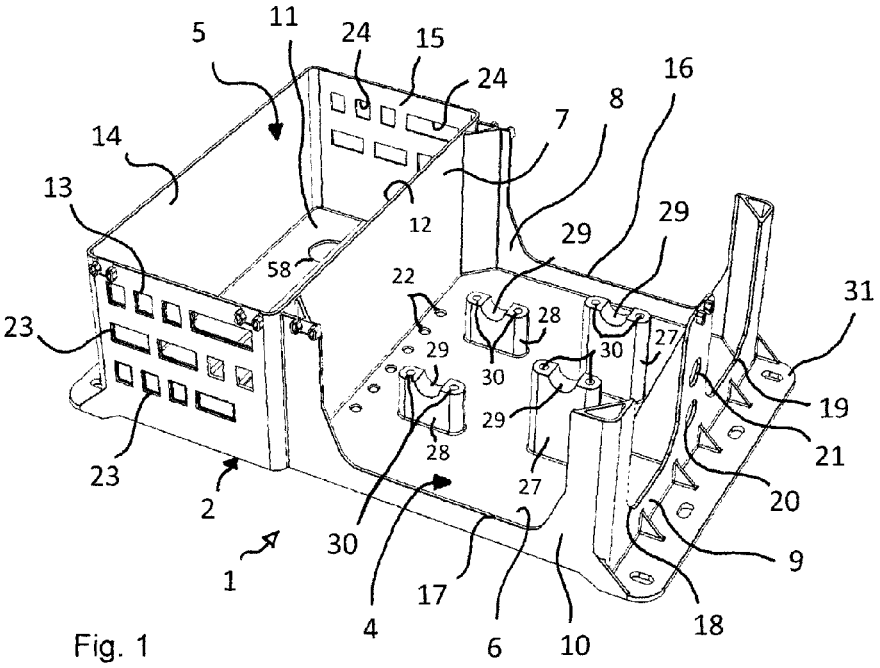
FIGS. 1 and 2 are perspective top view of a housing according to a particular embodiment of the present invention.
Figure 2:
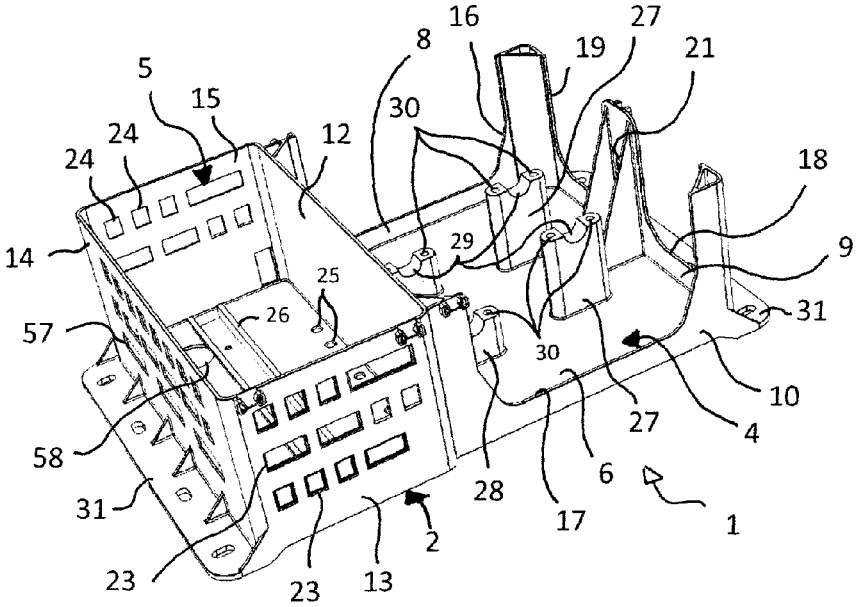

With reference to FIGS. 1, 2, 12 and 13, a housing 1 according to the present invention comprises a housing body 2 and a lid assembly 3.

The housing body 2 has a generally parallelepiped shape and is divided into a hydraulic control compartment 4 and an electronic control compartment 5.

The hydraulic control compartment 4, of a parallelepiped shape, is defined by a bottom wall 6 and four side walls 7, 8, 9, 10, forming a receiving space for the hydraulic equipment.

The electronic control compartment 5, of a parallelepiped shape, is defined by a bottom wall 11 and four side walls 12, 13, 14, 15, forming a receiving space for electronics.

The hydraulic 4 and electronic 5 control compartments are separated from each other in a fluid-tight manner by a partition formed by the side wall 7, 12 shared by these two compartments 4, 5.

The hydraulic control compartment 4 has, in each of the side walls 8, 10 thereof connected by the partition-forming side wall 7, a substantially U-shaped notch 16, 17. The notches 16, 17 have the same shapes and dimensions and form a passage through the major part of said side walls 8, 10.

The hydraulic control compartment 4 also has, in the side wall 9 thereof opposite to the partition-forming side wall 7, two notches 18, 19 separated from each other by a side wall portion having two circular openings 20, 21 provided one above the other.

The hydraulic control compartment 4 also has, in the bottom wall 6 thereof, in the vicinity of the partition-forming side wall 7, six circular slots 22, mutually spaced at a regular interval, aligned along the partition-forming side wall 7.

The electronic control compartment 5 has, in each of the side walls 13, 15 adjacent to the partition-forming side wall 12, cuts 23, 24 of rectangular and square shapes, as well as pre-cuts 57 on the outer surface of the side wall 15, the function of which will be explained hereinafter.

Figure 3:
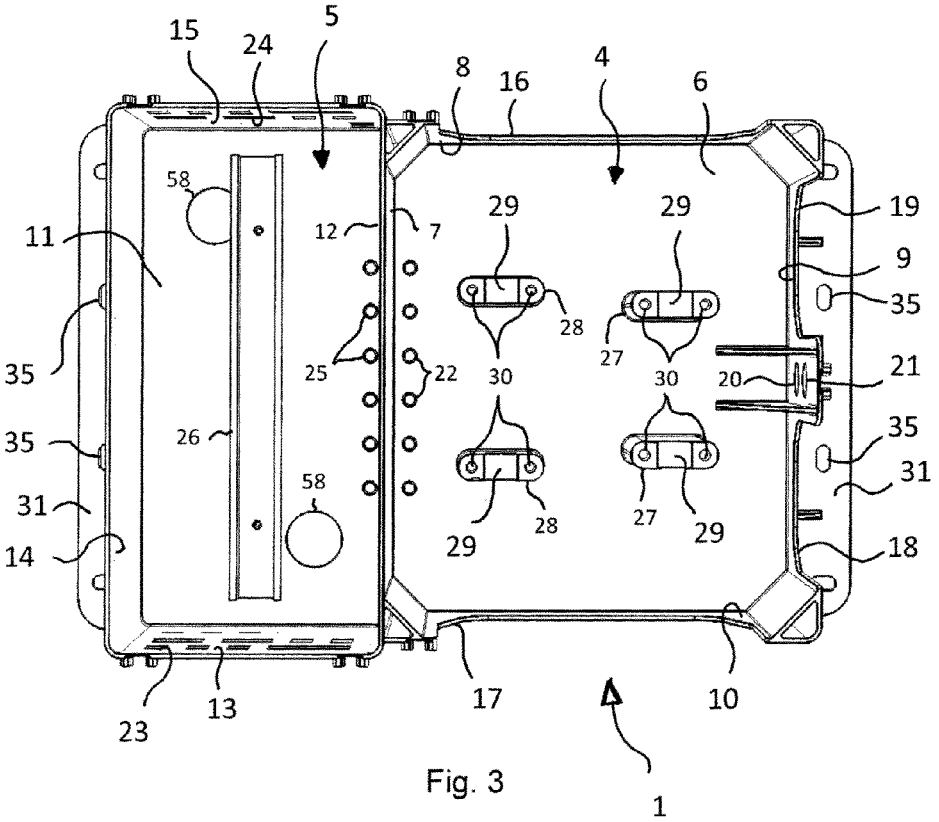
FIG. 3 is a top plan view of the housing of FIGS. 1 and 2.

In addition, with reference to FIG. 3, the electronic control compartment 5 also has, in the bottom wall 11 thereof, six circular slots 25, mutually spaced at a regular interval, aligned along the partition-forming side wall 12. The six circular slots 22 and the six circular slots 25 are aligned in pairs.

The electronic control compartment 5 is also provided with a fixation rail 26 extending substantially at the center of the bottom wall 11 in parallel with the partition-forming side wall 12, and secured to the bottom wall 11.

Furthermore, two circular openings 58 with dimensions larger than the ones of the circular openings 25 are provided in the bottom wall 11, on both sides of the fixation rail 26, so as to allow a natural passage of air for cooling of the electronic control compartment 5.

With reference to FIGS. 1 to 4, the hydraulic control compartment 4 comprises means for supporting piping element(s) which are formed by four pillars 27, 28.

Each pillar 27, 28 is in the form of a parallelepiped shaped block extending from the bottom wall and perpendicularly to the same, having a lower face integral with the bottom wall 6 and an opposite and free upper face. The upper face of each pillar 27, 28 has a semi-cylindrical bearing surface 29 and, on both sides of the same, two flat surfaces having a threaded hole 30 for the passage of fixation screws.

The four pillars 27, 28 are provided on the bottom wall 6 so as to form the four corners of a square or a rectangular at the center of the bottom wall 6, when viewed from above. A pair is formed by two pillars 27, or by two pillars 28, provided facing each other in a direction that is parallel to the partition. Two pillars 27, 28 of the same pair are provided such that the axes of the semi-cylinders of each bearing surfaces 29 are coaxial. The two pillars 28, on the partition-forming side wall 7, 12 side, have a same first height defined between the bottom wall 6 and the axis of the cylinder followed by the bearing surfaces 29, in the direction that is orthogonal to the bottom wall 6. The two pillars 27, on the side wall 9 side, opposite to the partition-forming wall 7, 12, have also a same second height, defined in a way similar to the first height and greater that the latter.

The pillars 27, 28 of the same pair could be offset from the pillars 27, 28 of the other pair with respect to the direction that is orthogonal to the plane of the partition-forming side wall 7, 12.

Figure 4:
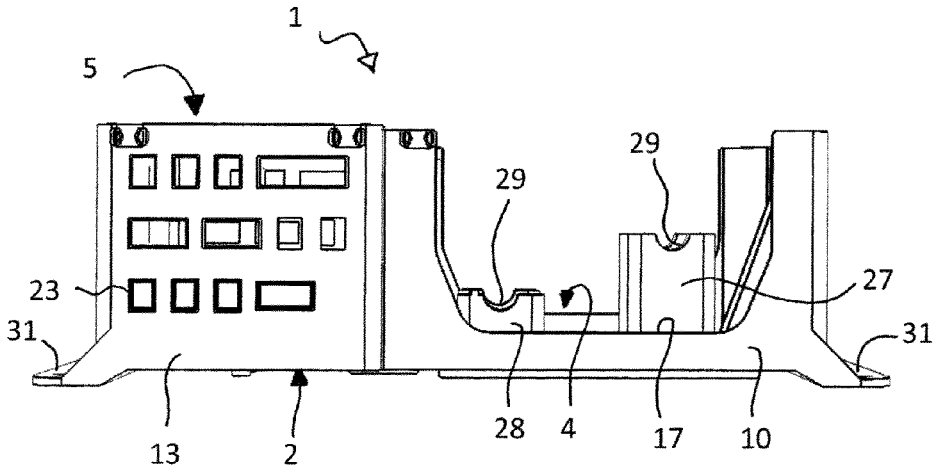
FIG. 4 is a side elevation view of the housing of FIG. 3.
Figure 5:
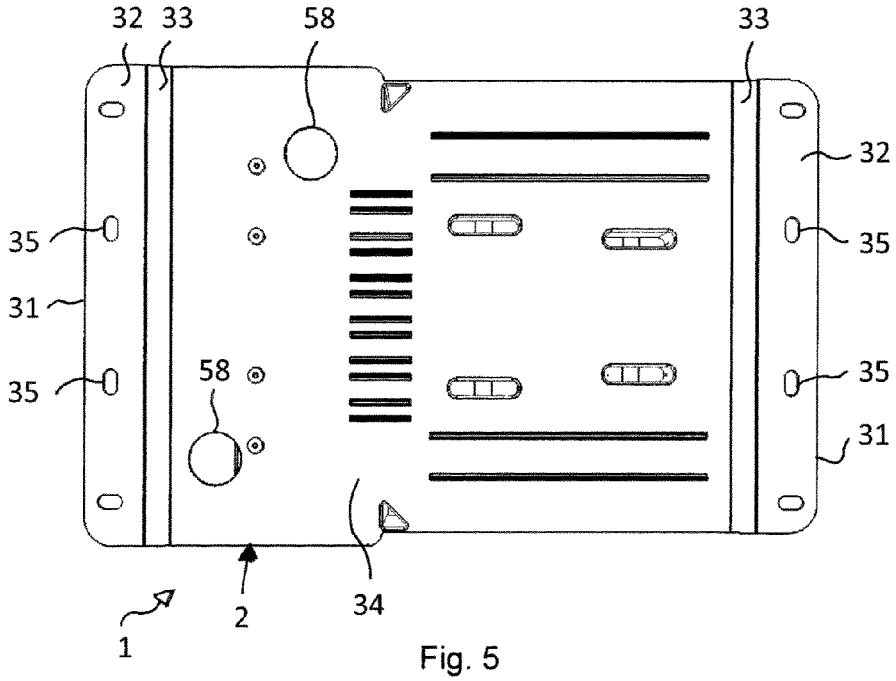
FIG. 5 is a bottom plan view of the housing according to the particular embodiment of the present invention.
Figure 6:
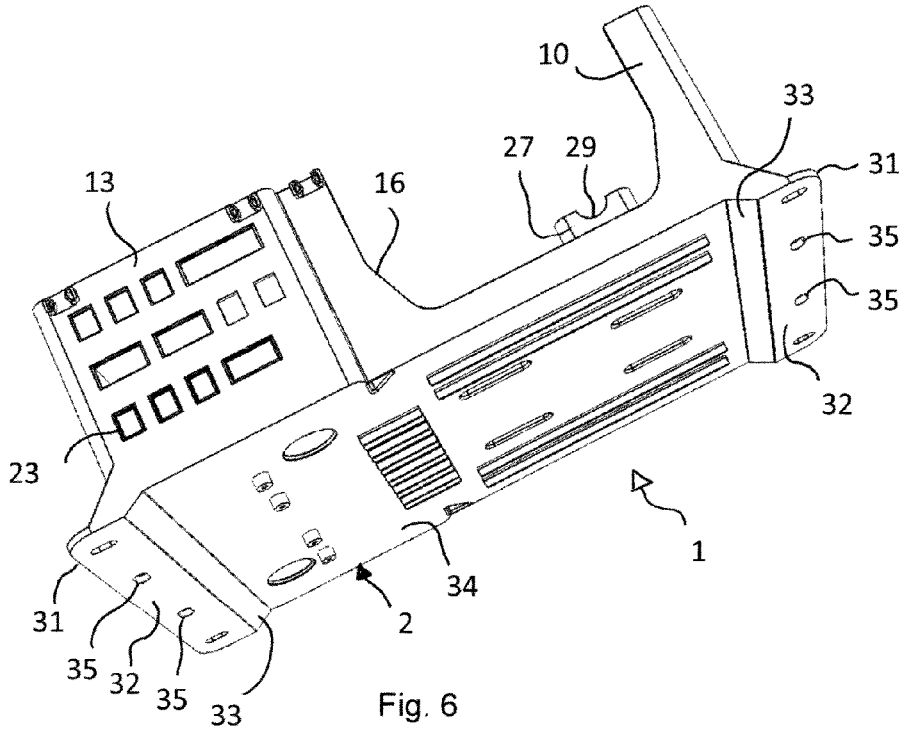
FIG. 6 is a perspective bottom view of the housing according to a particular embodiment of the present invention.

With reference to FIGS. 4 to 6, the bottom walls 6, 11 of the electronic 5 and hydraulic 4 control compartments are formed by a single flat plate. Two mounting flanges 31 extend from said flat plate, on the outside of the side walls 9, 14, opposite to the partition-forming wall 7, 12. These mounting flanges 31 have, on the side opposite to the receiving spaces, a flat lower surface 32 connected to the central portion 34 of the flat plate by an inclined surface 33, thus defining a space between the flat lower surface 32 of each mounting flange 31 and the outside surface of the central portion 34 of the flat plate. These mounting flanges 31 comprise openings 35 along them for the passage of fixation elements, such as screws, threaded rods, etc., for securing the housing 1 to a wall, a ceiling or a ground.

Figure 7:
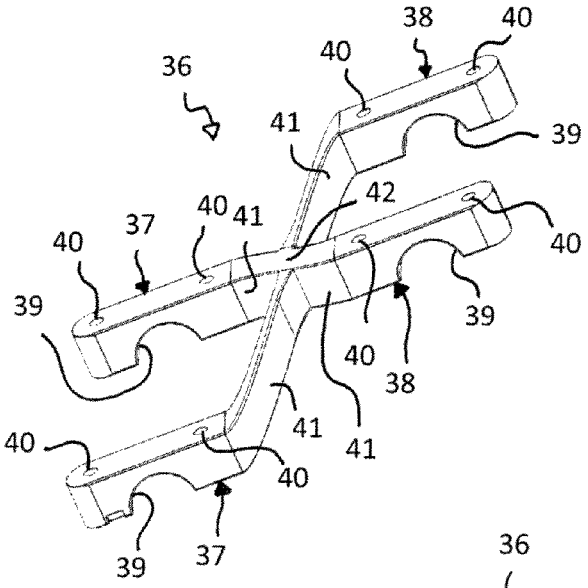
FIGS. 7, 8 and 9 are top perspective view, bottom perspective view and side elevation view, respectively, of a means for locking in position according to the particular embodiment of the present invention.
Figure 8:
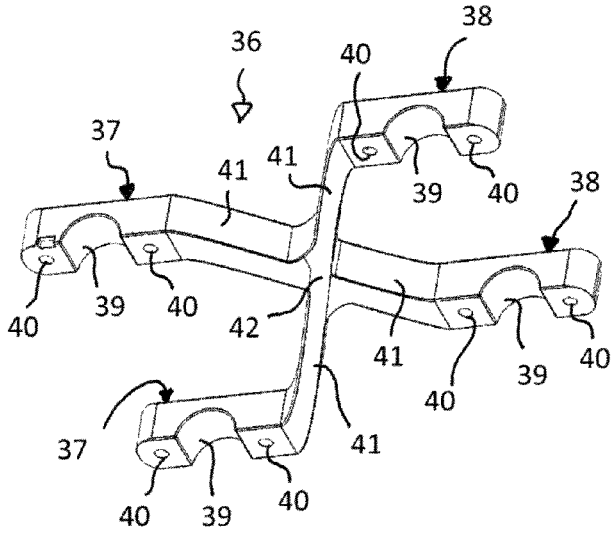
Figure 9:
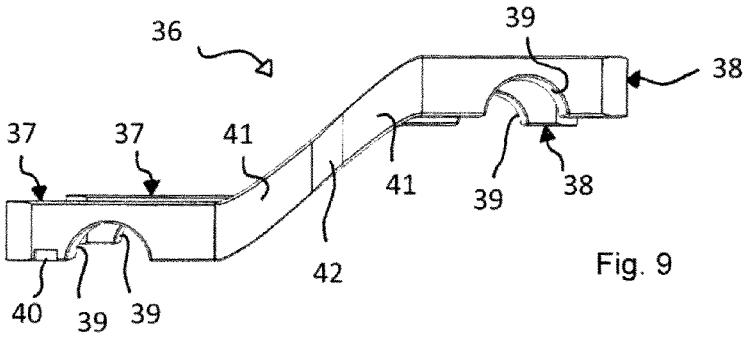

With reference now to FIGS. 7 to 9, has been shown thereon a locking member 36 according to the present invention, which constitutes a means for locking in position at least one piping element by clamping against the bearing surfaces 29 of the pillars 27, 28.

The rigid locking member 36 is substantially cross-shaped, in a top or bottom plane view, comprising four arms 37, 38 forming two pairs, the two arms 37, 38 of the same pair being parallel with each other and facing each other.

Each arm 37, 38 is constituted by a first parallelepiped shaped portion and a second connecting portion.

The first parallelepiped shaped portion has an upper surface and a lower surface in which is provided a semi-cylindrical clamping surface 39 between two flat surfaces into each of which opens a through hole 40 for the passage of a fixation screw.

The clamping surfaces 39 of the two arms 37, which belong to the same pair, follow cylinders of the same radius and coaxial, and the same applies for the clamping surfaces 39 of the two arms 38.

As it can be better seen on FIG. 9, the second connecting portions are in the shape of inclined member portions 41 which join at the center of the rigid member, at 42, the member portions 41 being inclined such that the arms 37, 38 of the same pair are offset in height with respect of the arms 38, 37 of the other pair.

Will now be described the manner with which the locking member 36 allows to maintain in position one or more piping elements, with reference to FIGS. 10 and 11.

Figure 10:
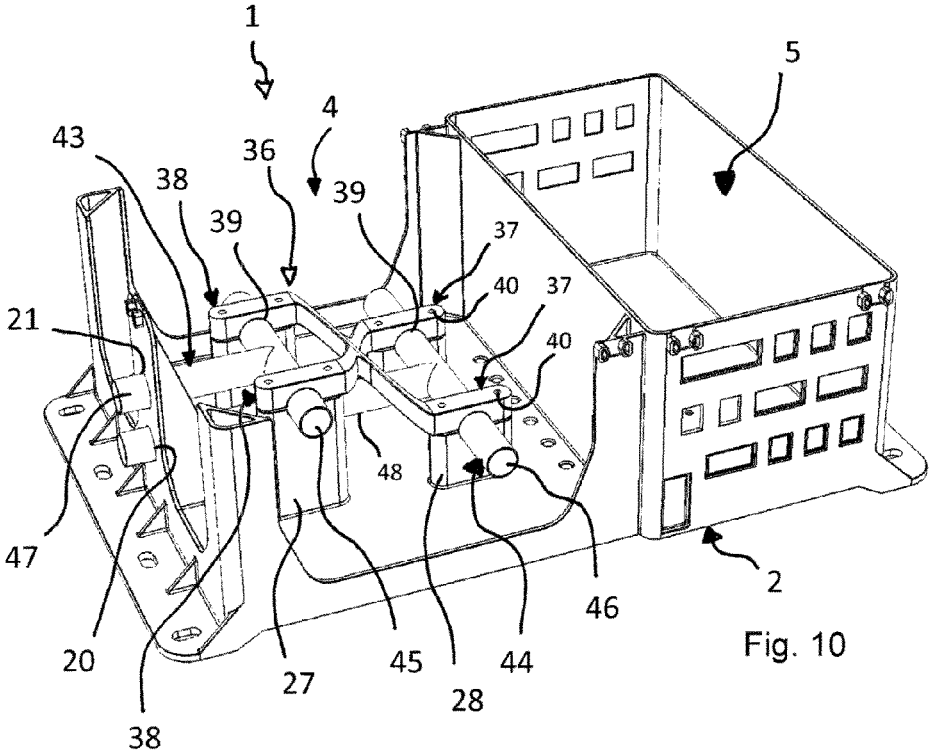
FIG. 10 is a perspective top view of the housing according to the present invention, shown with T-shaped piping elements placed in the hydraulic control compartment.

First we reference to FIG. 10, two T-shaped piping elements 43, 44 can be simultaneously maintained in position in the hydraulic control compartment 4 by being clamped between the bearing surfaces 29 and the clamping surfaces 39, the piping element 43 being above the piping element 44.

Each of the piping elements 43 and 44 is composed of a first branch respectively 45, 46, which forms the horizontal bar of the T, and of a second branch respectively 47, 48, which forms the vertical bar of the T, the various branches being cylindrical, of a radius slightly smaller than the one of the cylinders followed by the bearing surfaces 29 and the clamping surfaces 39.

The piping elements 43, 44 are supported by the pair of pillars 27 and 28, respectively, the first branch 45, 46, respectively, being received on the two bearing surfaces 39 of the pillars 27, 28, respectively, and the second branch 47, 48, respectively, being passed through the opening 21, 20, respectively, which is located so that the axis thereof is at the same height as the axis of the cylinder followed by the bearing surfaces 29 of the pillars 27, 28, respectively, and which corresponds to the axis of the first branch 45, 46, respectively, after the piping element 43, 44, respectively, has been positioned.

Once in this position, the locking member 36 is placed on the piping elements 43, 44 such that each clamping surface 39 is facing a respective bearing surface 29. To this end, it is to be noted that the radius of the cylinder followed by the clamping surfaces 39 of the same pair of arms 37, 38 is equal to the one of the cylinder followed by the bearing surfaces 39 of the pair of pillars 27, 28 the clamping surfaces 39 are facing in the locking position, and that the distance separating two clamping surfaces 39 of the same pair of arms 37, 38 is equal to the distance separating the two bearing surfaces 29 of the respective pair of pillars 27, 28.

After the rigid member 36 is placed in such a way on the piping elements 43, 44, the rigid member 36 is clamped against the pillars 27, 28 by screwing screws (not shown) through the holes 30 and 40, respectively, which in this position are aligned.

It can thus be noted that the two pairs of pillars 27, 28, which form two pairs of bearing surfaces 29, allow to support two T-shaped piping elements 43, 44 and locking in position the same is achieved with a single locking element 36 that is clamped against each of the bearing surfaces 29.

Figure 11:
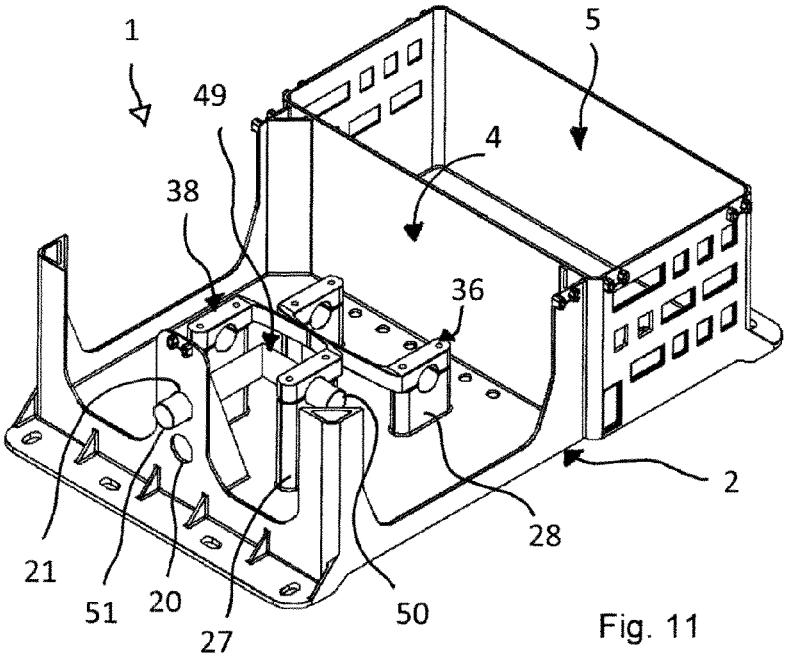
FIG. 11 is a bottom perspective view of the housing according to the present invention, shown with a L-shaped piping element placed in the hydraulic control compartment.

With reference now to FIG. 11, an L-shaped piping element 49 can be installed with the same control box 1. Indeed, the cylindrical first and second branches 50, 51 of the L are supported, for the first one 50, by a pillar 27 and, for the second one 51, by the opening 21, and the piping element 49 is locked in position by the rigid member 36 that is clamped on the latter in the same way as for the T-shaped piping elements 43, 44.

Of course, a second L-shaped piping element could be maintained in position in the same manner between one of the pillars 28 and the locking member 36.

It is here noted that it could well be contemplated for install a T-shaped piping element, supported by one of the pairs of pillars 27, 28, and an L-shaped piping element, supported by the other pair of pillars 27, 28.

A rectilinear piping element could also be installed, supported by the two pillars 27 or 28 of the same pair.

Figure 12:
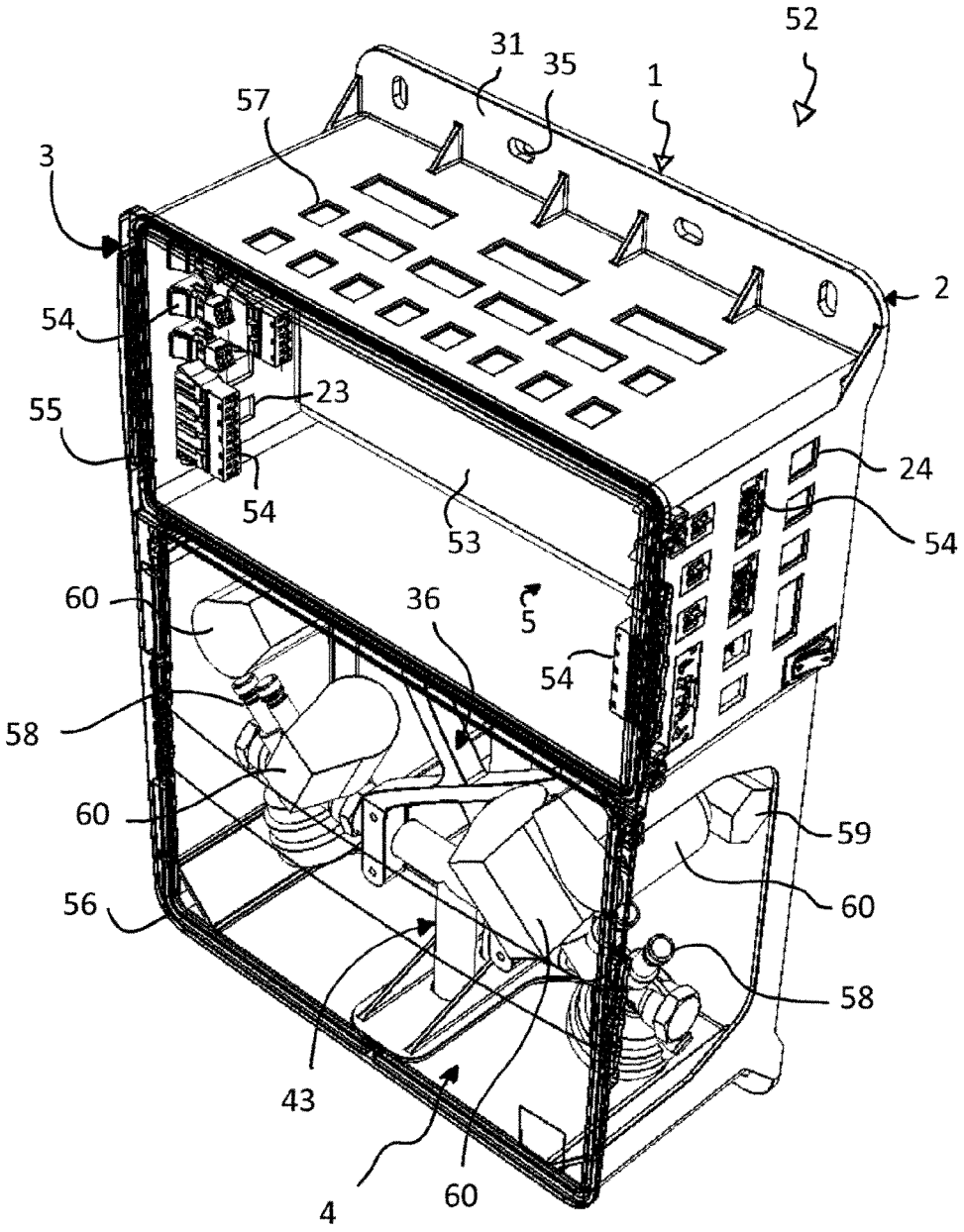
FIGS. 12 and 13 are perspective views of a heating, ventilation and air conditioning control system, provided with a housing according to the present invention.
Figure 13:
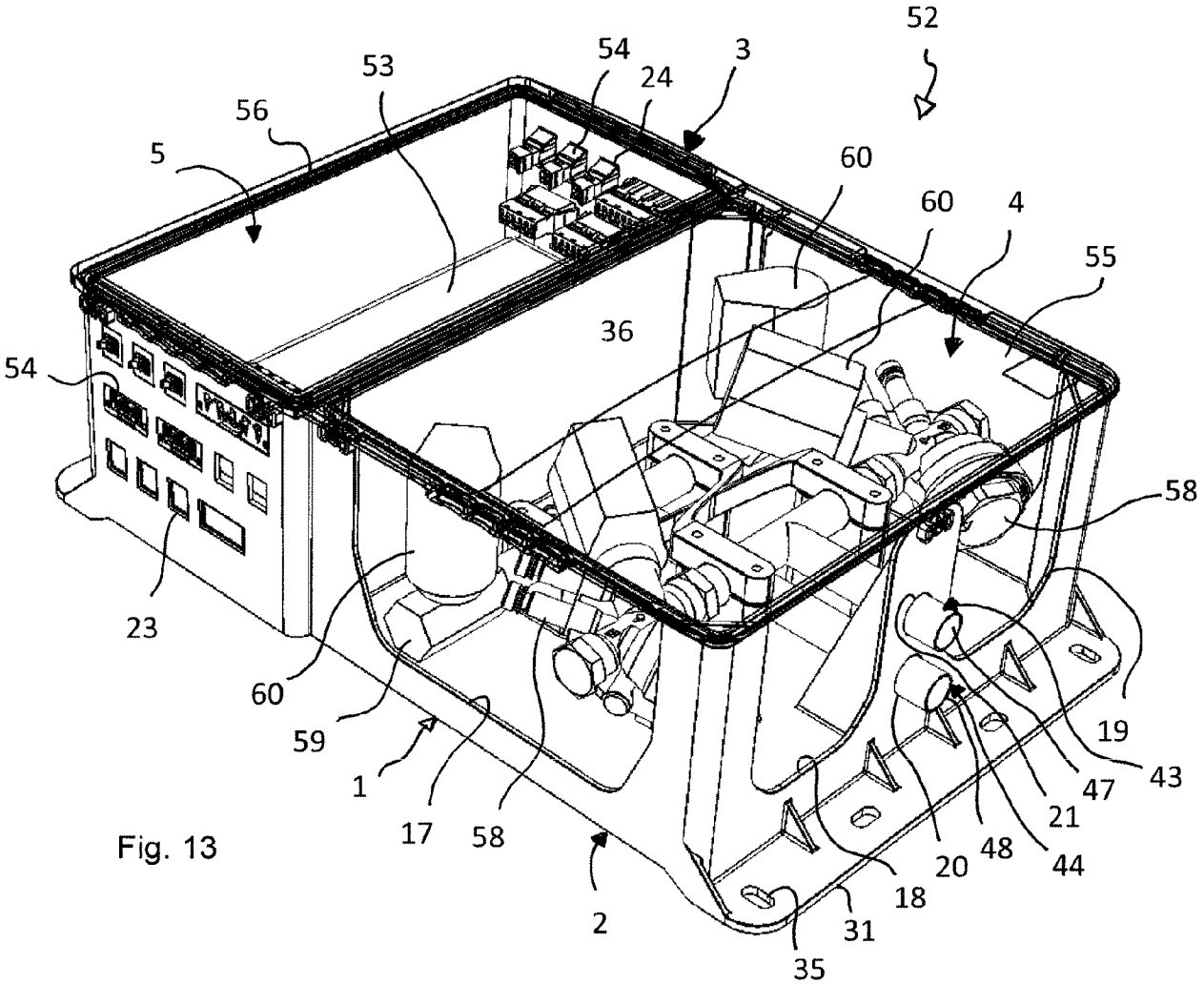

Finally, with reference to FIGS. 12 and 13, a heating, ventilation or air conditioning control system 52 according to the present invention comprises a control housing 1, a hydraulic equipment installed in the hydraulic control compartment 4, an electronic automatic control system 53 and connectors 54 placed in the electronic control compartment 5.

Each compartment 4, 5 is closed by a lid 55, 56, respectively, forming together a lid assembly 3.

In the example that has been illustrated, the hydraulic equipment is formed by two T-shaped piping elements, locked in position in the manner described with reference to FIG. 10, by two adjustable hydraulic control valves 59, for controlling the maximal water flow rate, each mounted on a site of the first branch 45 of the piping element 43 and each equipped with its servo-actuator 60, and by two adjustable hydraulic control valves 50 each mounted on a side of the first branch 46 of the piping element 44 and each equipped with its servo-actuator 60.

Such a hydraulic equipment allows a plurality of operation modes, well known in the art.

Of course, a hydraulic equipment with another arrangement could be installed in the control box 1, depending on the end-use requirements.

The electronic automatic control system 53 is secured on the rail 26, and various built-in and plug-in type connectors 54 placed in the electronic control compartment 5 are mounted, according to the needs of the required applications, in the cuts 23, 24 and/or the pre-cuts 57, after the latter have been cut out, of the electronic control compartment 5, and connected to the automatic control system 53. Besides, the automatic control system 53 is connected to the various valves and servo-actuators placed in the hydraulic control compartment 4 by wires passing through the slots 22 and 25, such that the automatic control system 53 can control the valves and servo-actuators to obtain the desired operation of the emitter(s) to which the housing 1 will be connected. The slots that are not used could be blocked by plugs (as shown on FIGS. 5 and 6) or will not be cut out at the time of the manufacturing, and the wires passing between the two compartments will not be damaged after the housing 1 is secured to a wall, thanks to the spacing between said wall and the central portion of the flat plate constituting the bottom of the housing 1, obtained by use of the flanges 31.

The system 52 according to the present invention can be delivered as is, with the desired hydraulic equipment already installed, the valves already adjusted and already connected to the automatic control system 43, to the end user who then just needs to secure the housing 1 against a wall, to connect the hydraulic equipment to the piping, for example with quick-release couplings, and to connect the electronics to a power supply, a building management computer, etc., using plug-in type connectors that are connected to the connectors already in the housing 1.

Thus, it can be noted that the system according to the present invention allows to significantly reduce the costs and time for installation.

It is underlined here that the automatic control system 53 can fulfill other functions not related to the heating, air conditioning or ventilation, and for example can be used to control blinds/awnings, lightings, etc., via connectors provided to that end and already mounted in the housing 1.

Of course, the particular embodiment that has been described, as well as a variant thereof, has been provided for illustrative and non-limitative purposes and modifications can be made without departing from the scope of the present invention.

The invention claimed is:

1. A control housing for a heating or ventilation or air conditioning system, the control housing comprising:

a housing body closed by a lid assembly, wherein the housing body comprising at least one hydraulic control compartment in which a hydraulic equipment-receiving space is formed, the hydraulic control compartment comprising at least one opening for piping element(s) to pass through, for entry and exit of one or more piping elements into and out of the control housing, the hydraulic equipment-receiving space further comprising position maintaining means for maintaining in position at least one piping element, wherein the housing body also comprises, separated from the hydraulic control compartment in a fluid-tight manner, an electronic control compartment for a heating or ventilation or air conditioning and/or large/light current control system, defined by a bottom wall and side walls and in which are provided means for securing at least one automatic control system for controlling valves of hydraulic equipment, at least one opening for power supply wires and connectors being made in at least one side wall, and means for allowing the passage of wires between the electronic control compartment and the hydraulic control compartment being provided.

2. The control housing according to claim 1, wherein the hydraulic equipment-receiving space is defined by a bottom wall and side walls and wherein the position maintaining means comprises, on one hand, means for supporting piping element(s) and which are formed by at least one pair of bearing surfaces integral with the housing body, the two bearing surfaces of the same pair being orthogonally symmetric with respect to a plane orthogonal to a straight line passing by both bearing surfaces and, on the other hand, means for locking in position at least one piping element against at least one bearing surface.

3. The control housing according to claim 2, wherein the bearing surfaces and the means for locking are capable of allowing a locking by clamping against at least one bearing surface.

4. The control housing according to claim 3, wherein the bearing surfaces each follow an arc of cylinder, and the cylinders whose arcs are followed by the two bearing surfaces of the same pair of bearing surfaces are of the same radius and coaxial, and have an axis parallel to the bottom wall.

5. The control housing according to claim 4, wherein each bearing surfaces is formed on the free end face of a pillar which, at the other end thereof, is integral with the housing body.

6. The control housing according to claim 5, wherein the housing comprises at least two pairs of bearing surfaces integral with the same wall of the hydraulic control compartment.

7. The control housing according to claim 6, wherein the distance between two bearing surfaces of the same pair of bearing surfaces is equal to the distance between the two bearing surfaces of the other pair of bearing surfaces, the distances being taken in a direction that is parallel to the wall of the hydraulic control compartment with which the bearing surfaces are integral.

8. The control housing according to claim 7, wherein each pair of bearing surfaces is offset with respect to the other pair(s) of bearing surfaces in the direction that is orthogonal to the wall with which the pillars are integral.

9. A control housing for a heating or ventilation or air conditioning system, the control housing comprising:

a housing body closed by a lid assembly, wherein the housing body comprising at least one hydraulic control compartment in which a hydraulic equipment-receiving space is formed, the hydraulic control compartment comprising at least one opening for piping element(s) to pass through, for entry and exit of one or more piping elements into and out of the control housing, the hydraulic equipment-receiving space further comprising position maintaining means for maintaining in position at least one piping element, wherein the hydraulic equipment-receiving space is defined by a bottom wall and side walls and wherein the position maintaining means comprises, on one hand, means for supporting piping element(s) and which are formed by at least one pair of bearing surfaces integral with the housing body, the two bearing surfaces of the same pair being orthogonally symmetric with respect to a plane orthogonal to a straight line passing by both bearing surfaces and, on the other hand, means for locking in position at least one piping element against at least one bearing surface, and wherein the means for locking in position piping element (s) are formed by a rigid member having, for the or each pair of bearing surfaces, a pair of clamping surfaces symmetrical with respect to a plan that is orthogonal to a straight line passing by both clamping surfaces, the distance separating the clamping surfaces of the same pair of clamping surfaces being equal to the distance separating the bearing surfaces of the corresponding pair of bearing surfaces, such that when at least one piping element is locked in position by the rigid member, each clamping surface of the same pair of clamping surfaces is facing a respective bearing surface of the corresponding pair of bearing surfaces, the rigid member being provided with means allowing to clamp the rigid member against the respective bearing surface.

10. The control housing according to claim 9, wherein the clamping surfaces each follow an arc of cylinder, and the cylinders an arc of which is followed by the two clamping surfaces of the same pair of clamping surfaces are coaxial and of the same radius.

11. The control housing according to claim 9, wherein the rigid member has a general shape of X, the free end regions of each arm of the X having a clamping surface.

12. The control housing according to claim 2, wherein two notches, each constituting an opening for piping element(s) to pass through, are made from the free edges of two side walls facing each other, wherein the notches are made to the vicinity of the bottom wall in order to facilitate the access to the inside of the hydraulic control compartment.

13. The control housing according to claim 12, wherein at least one opening for piping element(s) to pass through is made in the side wall adjacent to the two side walls in which the notches are made.

14. A control housing for a heating or ventilation or air conditioning system, the control housing comprising:

a housing body closed by a lid assembly, wherein the housing body comprising at least one hydraulic control compartment in which a hydraulic equipment-receiving space is formed, the hydraulic control compartment comprising at least one opening for piping element(s) to pass through, for entry and exit of one or more piping elements into and out of the control housing, the hydraulic equipment-receiving space further comprising position maintaining means for maintaining in position at least one piping element, wherein the hydraulic equipment-receiving space is defined by a bottom wall and side walls and wherein the position maintaining means comprises, on one hand, means for supporting piping element(s) and which are formed by at least one pair of bearing surfaces integral with the housing body, the two bearing surfaces of the same pair being orthogonally symmetric with respect to a plane orthogonal to a straight line passing by both bearing surfaces and, on the other hand, means for locking in position at least one piping element against at least one bearing surface, wherein two notches, each constituting an opening for piping element(s) to pass through, are made from the free edges of two side walls facing each other, wherein the notches are made to the vicinity of the bottom wall in order to facilitate the access to the inside of the hydraulic control compartment, wherein at least one opening for piping element(s) to pass through is made in the side wall adjacent to the two side walls in which the notches are made, the pillars being integral with the bottom wall of the hydraulic control compartment, wherein, for each pair of bearing surfaces, an opening for piping element(s) to pass through is provided in the side wall adjacent to the two side walls in which the notches are made, each opening extending along an axis at a distance of the bottom wall that is equal to the distance between the bearing surfaces of the respective pair of bearing surfaces and the bottom wall, the distances being taken in the direction that is orthogonal to the bottom wall.

15. The control housing according to claim 1, characterized by the fact that the bottom walls of the electronic and hydraulic control compartments are formed by a single flat plate, two opposite edge regions of which constitute mounting flanges the surfaces of which, on the bottom side of the housing, being offset, in the direction that is perpendicular to said plate, with respect to the outer surface of the central portion of the plate which forms the bottom walls, the means for allowing the passage of wires between the electronic and hydraulic control compartments being constituted by a series of wire passage slots which are made in the plate, first slots opening into the electronic control compartment and second slots opening into the hydraulic control compartment.

16. A heating or ventilation or air conditioning control system, comprising a control housing as defined in claim 1, a hydraulic equipment maintained in position by the position maintaining means.

17. A heating or ventilation or air conditioning control system, comprising a control housing as defined in claim 1, a hydraulic equipment maintained in position by the position maintaining means and at least one electronic automatic control system secured in the electronic control compartment.

* * * * *